US006309335B1

(12) United States Patent
Holton

(10) Patent No.: US 6,309,335 B1
(45) Date of Patent: Oct. 30, 2001

(54) VERTICALLY DISPLACED HOPPER FOR BLISS MACHINES

(75) Inventor: David B. Holton, Sanger, CA (US)

(73) Assignee: Delaware Capital Formation, Wilmington, DE (US)

( * ) Notice: Subject to any disclaimer, the term of this patent is extended or adjusted under 35 U.S.C. 154(b) by 0 days.

(21) Appl. No.: 09/437,555

(22) Filed: Nov. 10, 1999

(51) Int. Cl.[7] ..... B31B 17/02

(52) U.S. Cl. ..... 493/122; 493/120; 493/180

(58) Field of Search ..... 493/122, 120, 493/130, 167, 180, 163, 175, 177, 475, 478, 479, 102; 271/165, 138, 144, 171, 184, 185; 198/373, 411, 416; 53/389.1, 389.2, 563

(56) References Cited

U.S. PATENT DOCUMENTS

| | | | | |
|---|---|---|---|---|
| 1,697,709 | | 1/1929 | Bliss . | |
| 1,974,527 | | 9/1934 | Bliss . | |
| 3,059,753 | * | 10/1962 | Lisinski | 198/373 |
| 3,186,244 | | 6/1965 | Baker et al. . | |
| 3,196,761 | | 7/1965 | Ullman . | |
| 3,318,205 | | 5/1967 | Lefief . | |
| 3,456,563 | | 7/1969 | Roesner et al. . | |
| 3,465,652 | | 9/1969 | Bell et al. . | |
| 3,521,536 | | 7/1970 | Waldbauer et al. . | |
| 3,583,295 | | 6/1971 | Elder et al. . | |
| 3,590,700 | | 7/1971 | Paxton et al. . | |
| 3,626,819 | | 12/1971 | Hoyrup . | |
| 3,635,129 | | 1/1972 | Cobelo, Jr. . | |
| 3,638,537 | | 2/1972 | Cato . | |
| 3,808,959 | | 5/1974 | Perry . | |
| 3,812,875 | | 5/1974 | Paxton . | |
| 3,858,489 | | 1/1975 | Paxton . | |
| 3,935,798 | | 2/1976 | Paxton . | |
| 3,941,037 | | 3/1976 | Reichert . | |
| 3,952,635 | | 4/1976 | Mims . | |
| 4,023,471 | | 5/1977 | Royal . | |
| 4,197,789 | | 4/1980 | Moen . | |
| 4,201,118 | * | 5/1980 | Calvert et al. | 271/132 |
| 4,273,322 | | 6/1981 | Ginther, Sr. et al. . | |
| 4,283,188 | | 8/1981 | Wingerter et al. . | |
| 4,285,679 | | 8/1981 | Wahle . | |
| 4,348,853 | * | 9/1982 | Morse et al. | 53/566 |
| 4,557,472 | * | 12/1985 | Hannon | 271/133 |
| 4,596,542 | | 6/1986 | Moen . | |
| 4,798,571 | * | 1/1989 | Everman et al. | 493/114 |
| 4,807,428 | * | 2/1989 | Boisseau | 493/479 |
| 4,969,861 | * | 11/1990 | Crittenden | 493/102 |
| 4,988,331 | | 1/1991 | Boisseau . | |

(List continued on next page.)

*Primary Examiner*—Peter Vo
*Assistant Examiner*—Sam Tawfik
(74) *Attorney, Agent, or Firm*—Mark D. Miller

(57) ABSTRACT

Disclosed is a supply hopper apparatus for 3-part (Bliss) box forming machines having a vertical or substantially vertical orientation that is capable of holding a large supply of end panels. The trays of the hopper are open at the top and bottom, and may be adjusted to accommodate a wide range of differently sized end panels. A shuttle mechanism is provided at the bottom of each tray for removing the lowermost end panel from the tray, and an adjustable gate is provided to prevent more than one panel from being removed from the tray at a time. An elevating mechanism is provided adjacent to each tray to bring the lowermost panel from a generally horizontal position to a vertical position alongside the mandrel of the container forming machine. The mandrel then picks up the elevated end panels from each side, and takes them into the machine where they are used to form the three-part Bliss container. The vertically oriented trays of the present invention which use the shuttle, gate and elevating devices described herein allow for end panels to be stacked into the trays without the need for any special orientation, shuffling, stacking or monitoring of the end panels. Additional end panels may be stacked into the trays during operation of the machine without slowing or interrupting the progress of the machine.

28 Claims, 7 Drawing Sheets

U.S. PATENT DOCUMENTS

| | | | |
|---|---|---|---|
| 5,057,066 | 10/1991 | Nagahashi et al. . | |
| 5,104,368 | 4/1992 | Arbuthnot . | |
| 5,156,583 | 10/1992 | Baas . | |
| 5,312,316 | 5/1994 | Wu . | |
| 5,419,485 | 5/1995 | Petriekis et al. . | |
| 5,656,006 | 8/1997 | East et al. . | |
| 5,656,007 | 8/1997 | Olson et al. . | |
| 5,807,223 | 9/1998 | Holton . | |
| 5,876,319 | 2/1999 | Holton . | |
| 6,000,525 * | 12/1999 | Frulio | 198/411 |

* cited by examiner

VERTICALLY DISPLACED HOPPER FOR BLISS MACHINES

FIELD OF THE INVENTION

The present invention relates to container forming machines, and in particular to a new and improved apparatus for supplying end panels to machines which form Bliss-style containers.

DESCRIPTION OF THE PRIOR ART

In the packaging industry, numerous fiberboard containers and designs have been developed over the years. Such containers are typically constructed of a corrugated material. These materials may be single face corrugated, single wall (double-faced) corrugated, double wall corrugated, triple wall corrugated, etc. Containers may also be made of other paperboard products including, without limitation, container board, boxboard, linerboard, and cardboard.

Many different container box styles and types have also been developed over the years, each being optimally suited for one or more particular products or industries. One such container is known as a "Bliss" box which has special characteristics which make Bliss boxes highly desirable for use in bulk packing industries such as meats, explosives, fresh fruits and vegetables, and other areas where strong construction and stacking strength are important.

Bliss boxes were first developed in the 1920s, and were the subject of a number of early U.S. patents (e.g. U.S. Pat. Nos. 1,697,709 and 1,974,527). Generally speaking, a Bliss box is made of three distinct pieces of paperboard material. The first is an elongated panel or body matt, which is folded around itself in the shape of the letter "U." The folded body matt defines the bottom, front and back of the final container, leaving the top and ends of the container open. Two separate end panels, usually mirror-images of each other, are attached to the open ends of the larger folded panel to form a Bliss box that is open at the top. The top can then be closed using flaps attached to the front, back or end panels.

Because of its three-part construction, Bliss style boxes offer a wide range of variations in both construction and materials. For example, the end panels may or may not include upper flaps for closing the top of the box. The body matt may include two large flaps (one on the front panel, another on the back panel) to form the top of the box so that these flaps either meet or overlap; there may be only one large top flap (with or without a tuck-in lip) provided to form the top of the Bliss box; or some other suitable combination of large or small flaps from the front, back and/or end panels may be employed.

Similarly, the corner-area overlaps provided by the side panels may vary widely depending upon the degree of strength required. In some Bliss box variations, flaps are provided along the front and back of the body matt so that, when the body matt is folded over itself, these flaps create a frame to which the end panels may be attached (on the inside of the body matt). This way, instead of front and back panel flaps overlapping the outside of the body matt corners for attachment and strength, body matt flaps in these corners overlap the end panels. Such frames may be made with panels along both sides as well as the bottom end of the body matt. In many cases, the side panels and the body matt may be made of different paperboard materials (e.g., corrugated body matt and linerboard side panels). The overlapping areas of Bliss boxes are generally glued together, but may also be adhered using staples, rivets, or other similar attachment devices.

The process of manufacturing Bliss boxes first requires the creation of the three panels of the box. The size and shape of the final box is determined by the dimensions of these pieces which are, in turn, determined by the ultimate product to be placed therein. Once these dimensions are determined, the appropriate method and amount of top flap overlap is determined, as well as the manner and amount of attachment of the end panels to the body matt.

Special Bliss box forming machines have been developed over the years to assemble these three panels into the completed Bliss box, such as those described in U.S. Pat. Nos. 5,807,223 and 5,876,319. These machines employ a mandrel which moves back and forth along a track, retracting to pick up end panels as a body matt drops in front of the mandrel, the mandrel then moving forward bringing the end panels with it, bending the body matt over itself and adhering the end panels thereto. Unfortunately, the end panel supply hoppers provided with such machines do not have large capacity, and often require that the end panels be carefully oriented, shuffled, stacked in place, and closely monitored in order to avoid jamming the machine. Using such hoppers can slow down the production of the machine, and detracts from its otherwise automatic operation.

SUMMARY OF THE INVENTION

The present invention overcomes the aforementioned drawbacks of existing supply hoppers for Bliss box forming machines and provides an improved hopper having a vertical or substantially vertical orientation that is capable of holding a large supply of Bliss box end panels that need not be carefully shuffled, stacked or monitored in order to be used by the machine. The end panel supply hopper mechanism of the present invention includes a pair of vertically oriented adjustable trays, each tray providing one of the two end panels required by each Bliss box to be formed. The trays are open at the top and bottom, and may be adjusted to accommodate a wide range of differently sized end panels. A large number of panels may be stacked in each of these trays, the trays and stacks being limited only by the height of the ceiling where the machine they are attached to is located. Because of the vertical orientation of the hoppers, less side space is required around the machine when they are used. The trays are deployed along both sides of the path of the mandrel of the Bliss box forming machine.

A shuttle or pick mechanism is provided at the bottom of each of the vertically oriented trays, together with an adjustable gate for controlling the output from the hoppers. The position of each gate is set according to the thickness of the end panels in the hopper, in order to allow only one end panel at a time to be removed from the bottom of the stack. The shuttle or pick mechanism includes a removable slidable low-profile member that oscillates between a retracted position behind the tray, and an extended position immediately below the tray. The profile of the slidable member should be the same as or slightly less than the thickness of a single end panel in the stack. In this way, the slidable member will engage only the lowermost end panel in the stack. This identical structure is provided for each of the two trays of the supply hopper apparatus of the present invention.

The shuttles for each of the two trays operate simultaneously, beginning in the retracted position. The height of each gate is set so as to only allow a single end panel to pass underneath it at a time. A stack of end panels is then loaded into each of the generally vertical trays, each panel being in a generally horizontal position. Activation of the two shuttles causes the slidable member of each shuttle to move under each tray, moving the lowermost end panel out from under the tray. Each gate prevents any other panels which may be stacked on top of the lowermost panel from also being moved out of the tray. Each slidable member is then retracted out from under the tray and gravity causes each stack of panels to drop. The process then repeats, with the slidable members again removing the lowermost panels from the bottom of the stack in each tray.

An elevating mechanism is provided adjacent to each of the two trays. Each shuttle moves the lowermost panel out of the tray to a position above the corresponding elevating mechanism. As soon as the shuttle retracts, the elevating mechanism brings the panel from a generally horizontal position to a vertical position alongside the mandrel of the container forming machine. The mandrel then picks up the elevated end panels from each side, and takes them into the machine where they are used to form the three-part Bliss container. Meanwhile, the elevating mechanism retracts, awaiting delivery of the next panel from the shuttle. This process repeats over and over, with the shuttles delivering the lowermost panels from each of the trays, the elevating mechanisms standing the panels up in a vertical position, and the mandrel taking the panels away to be formed into a container.

The vertically oriented trays of the present invention which use the shuttle, gate and elevating devices described herein allow for end panels to be stacked into the trays without the need for any special orientation, shuffling, stacking or monitoring of the end panels. Additional end panels may be stacked into the trays during operation of the machine without slowing or interrupting the progress of the machine.

It is therefore a primary object of the present invention to provide a large capacity easy to use end panel supply hopper apparatus for use with machines which form three-part containers.

It is a further important object of the present invention to provide a hopper apparatus for supplying end panels that can be used on machines which form Bliss-style containers.

It is a further important object of the present invention to provide a high capacity hopper apparatus for supplying end panels to a three-part container forming machine which does not require special orientation, shuffling, stacking or monitoring of the end panels during use.

It is a further important object of the present invention to provide a pair of vertically oriented hoppers for supplying end panels to machines which form Bliss-style container boxes, each hopper including a shuttle and gate mechanism for removing the lowermost panel from the hopper, and a lifting element for bringing the end panels into a vertical position along side the mandrel of the machine.

Additional objects of the invention will be apparent from the detailed descriptions and the claims herein.

DETAILED DESCRIPTION OF THE DRAWINGS

Figure 1:
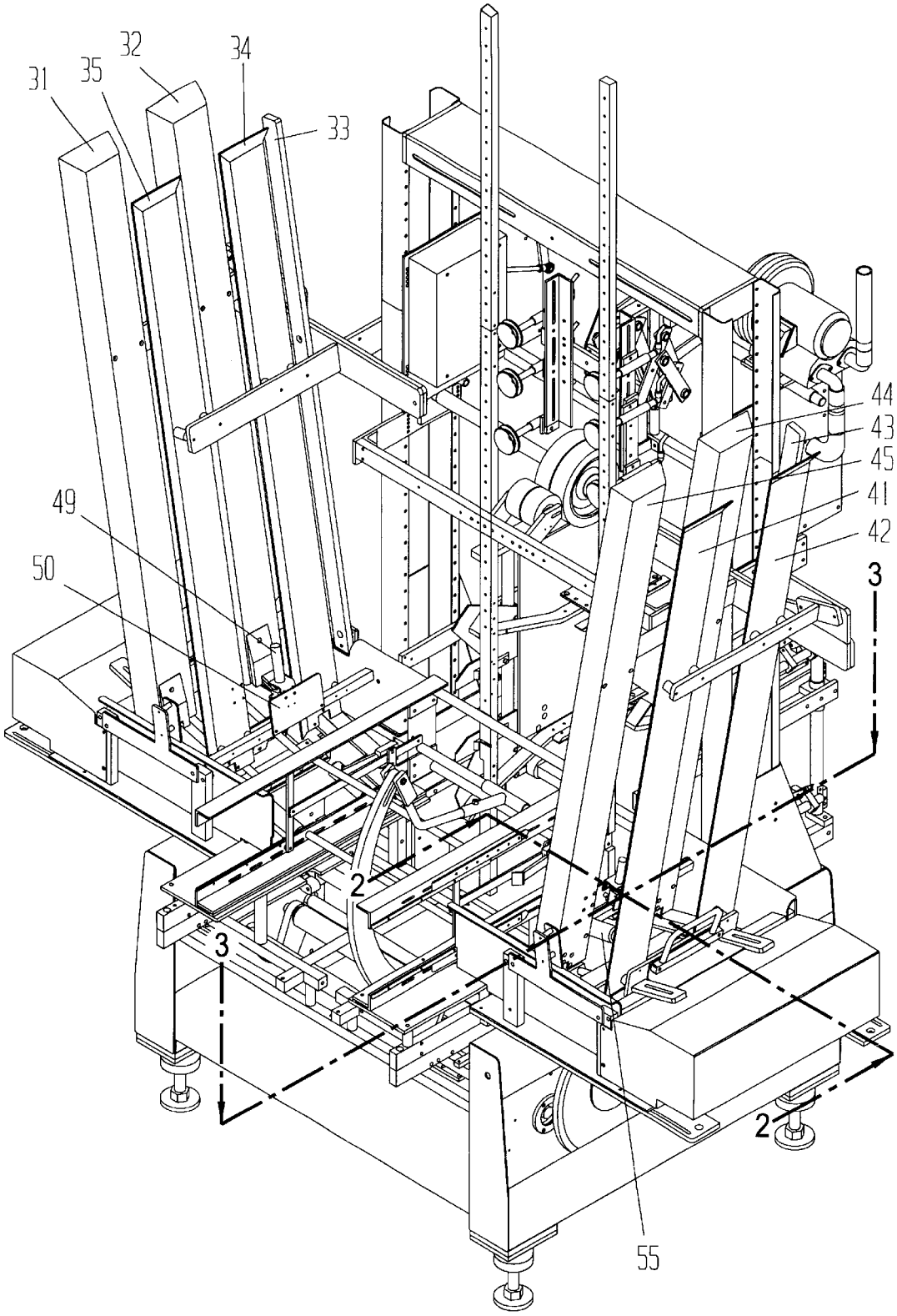
FIG. 1 is a perspective view of the operative parts of the machine of the present invention showing the two empty hopper trays.
Figure 4:
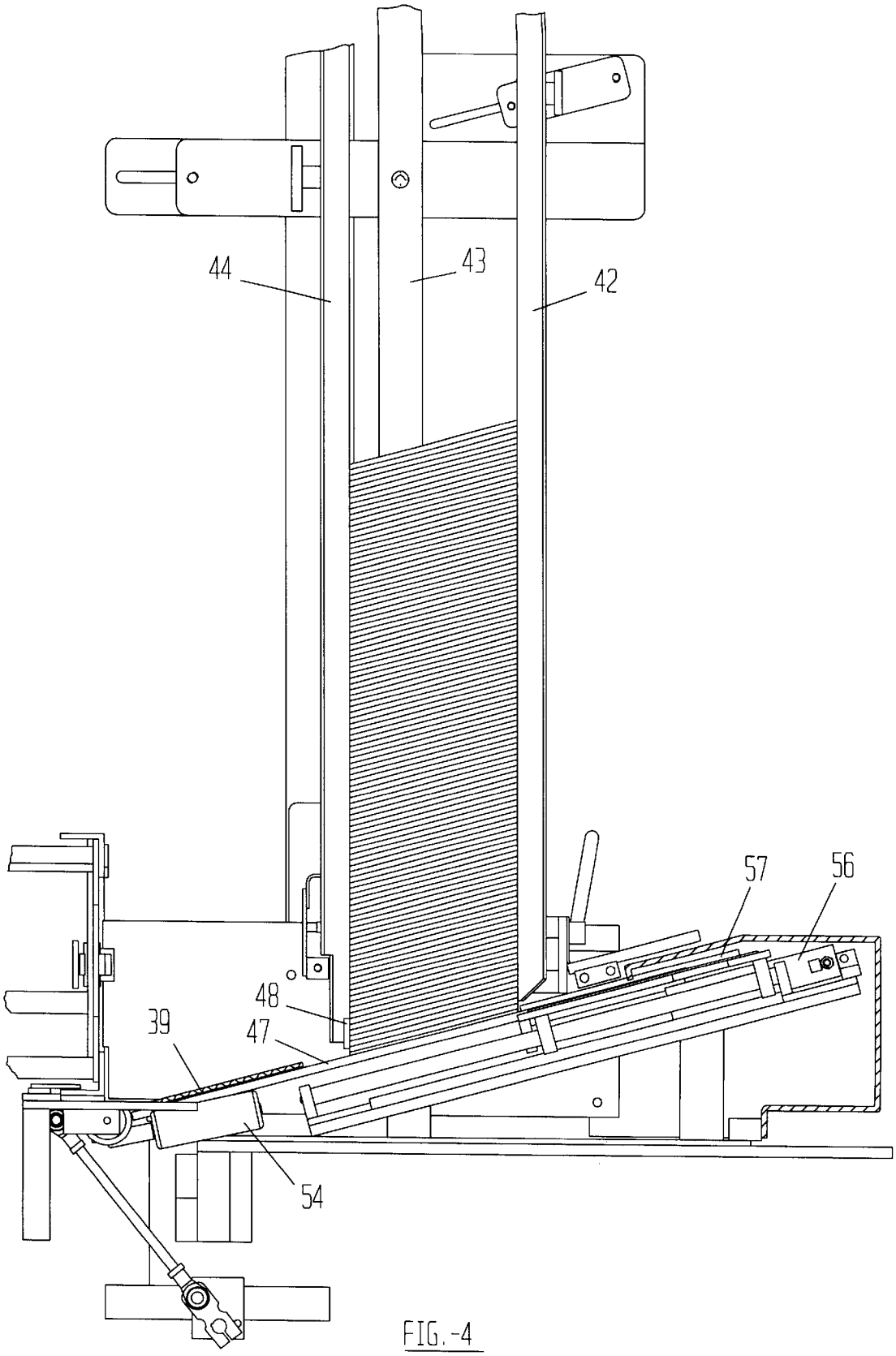
FIG. 4 is a side view similar to FIGS. 2*a*–2*c* showing the adjustable tray in a vertical position.

Referring to the drawings wherein like reference characters designate like or corresponding parts throughout the several views, and referring particularly to FIGS. 1 and 4, it is seen that two hoppers are provided in the present invention defined by adjustable support panel guides 31, 32, 33, 34 and 35 on one side, and 41, 42, 43, 44 and 45 on the opposite side. The panel guides may be adjusted to a nearly vertical position as shown in FIG. 4, and may also be adjusted relative to each other in order to accommodate end panels 39 of different lengths and widths. An optional end panel striker 49 attached to support plate 50 may be provided along panel guides 34 and 35 (and 44 and 45). If used, striker 49 is in contact with end panels 39 in the two hoppers, and constantly moves up and down, imparting slight motion to the end panels in order to prevent them from binding, jamming or bunching up in the hoppers.

Figure 2A:
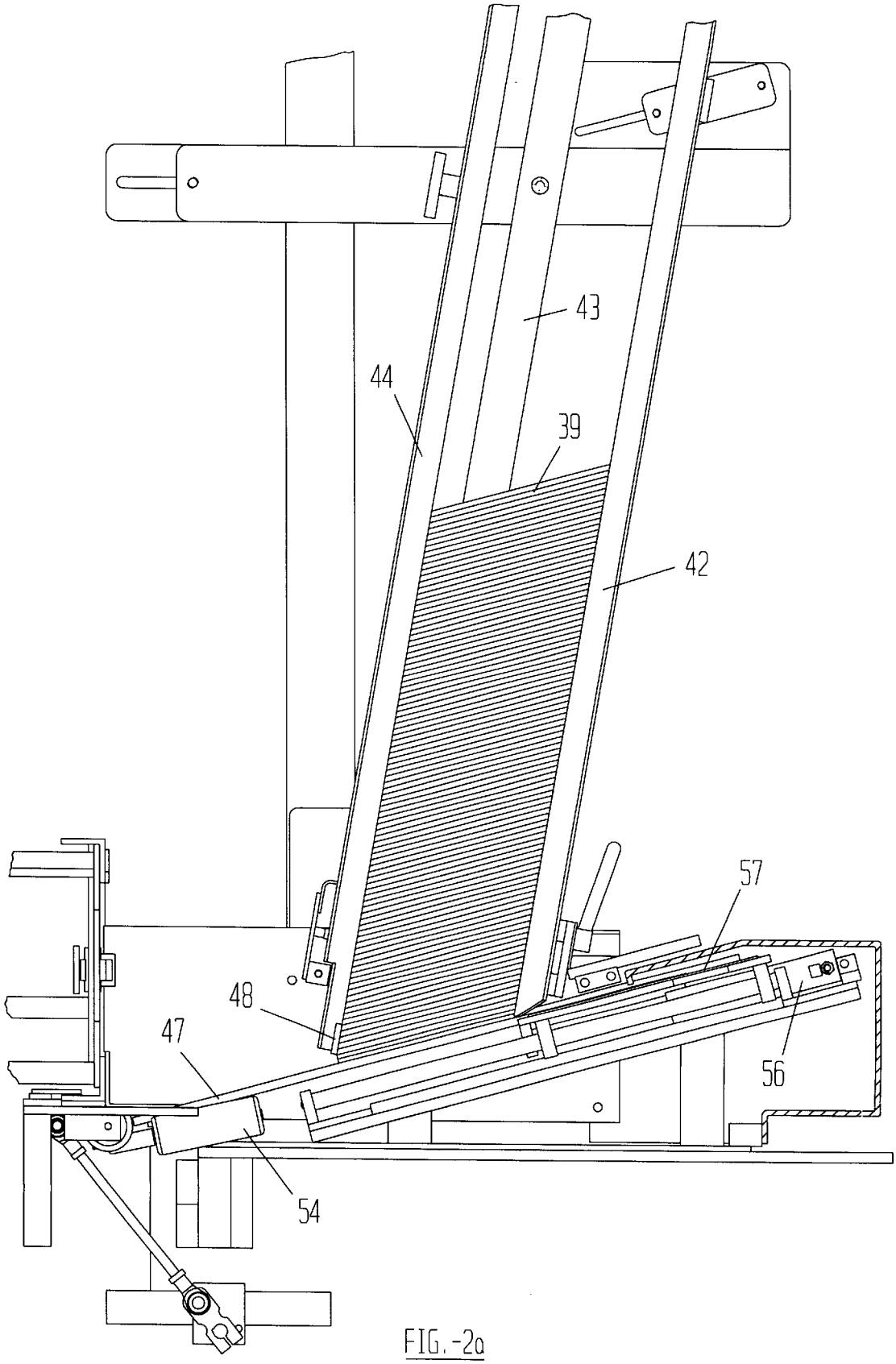
FIG. 2*a* is a sectional end view along line 2—2 of FIG. 1 showing the shuttle, gate and elevating mechanisms in their retracted positions.
Figure 2B:
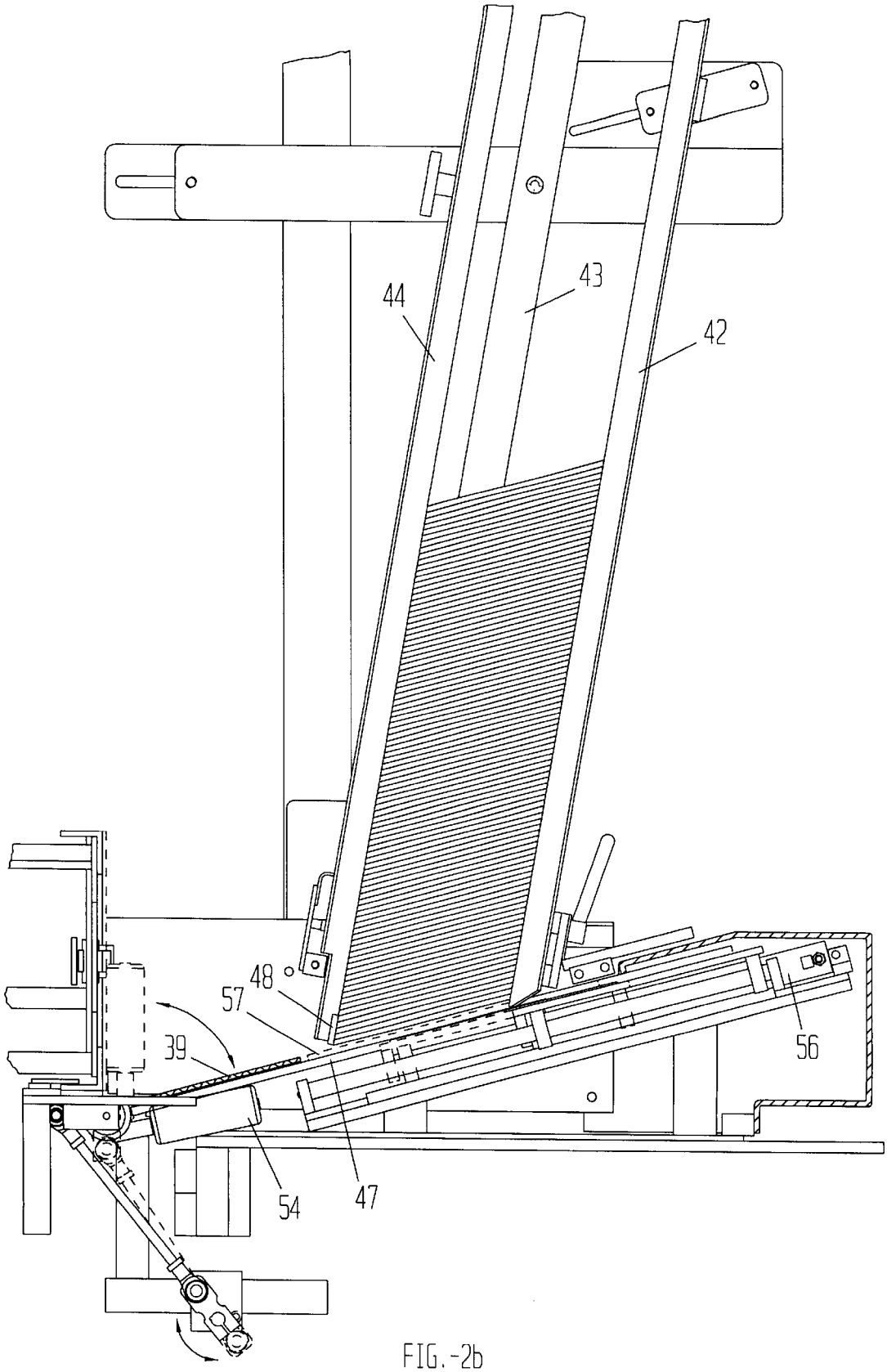
FIG. 2*b* is a sectional end view along line 2—2 of FIG. 1 showing the dispensement of the lowermost end panel from the tray. The extended position of the shuttle and the raised position of the elevating mechanism are shown in phantom lines.
Figure 2C:
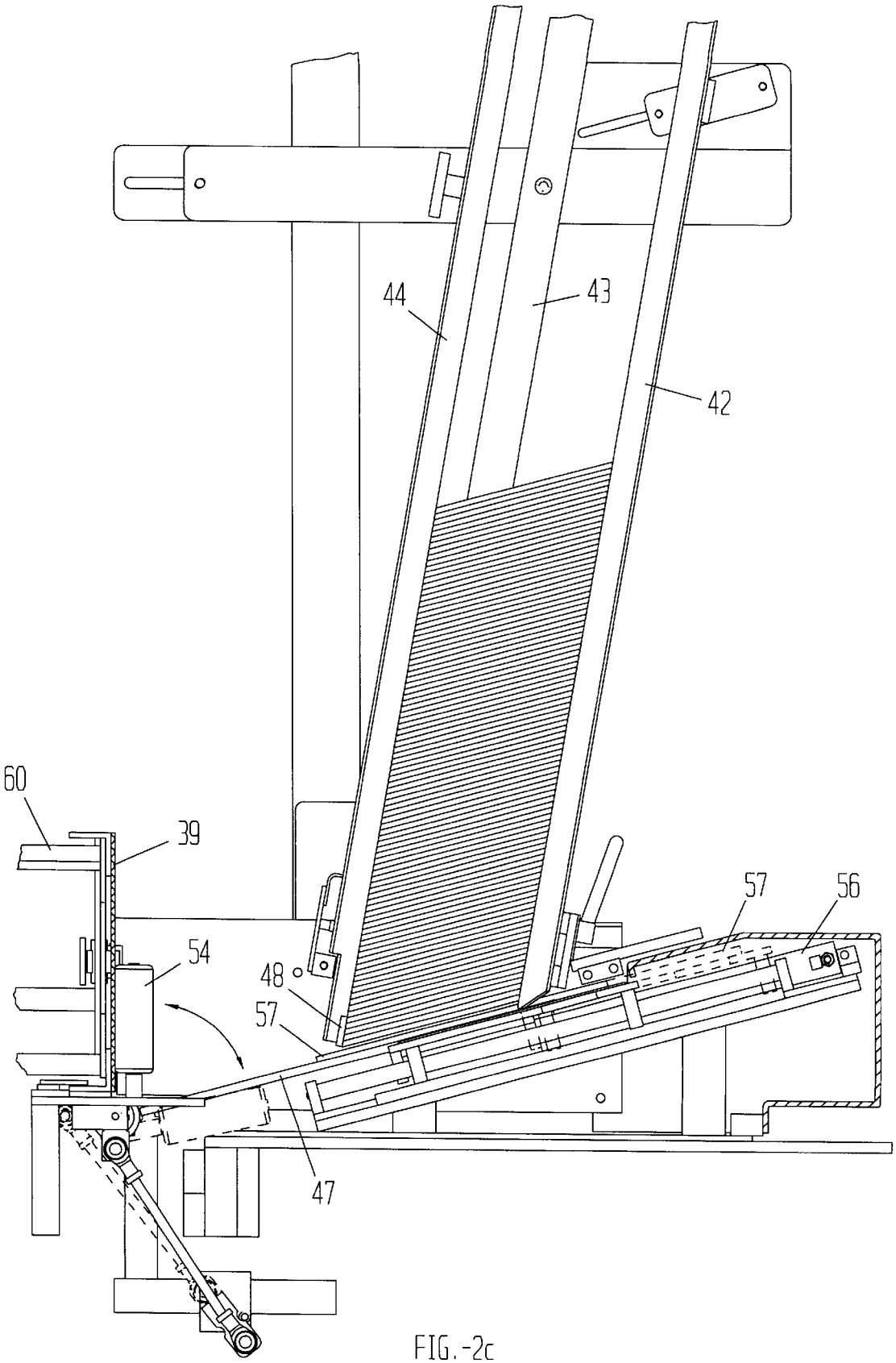
FIG. 2*c* is a sectional end view along line 2—2 of FIG. 1 showing the uplifting of an end panel to vertical alongside the mandrel, the shuttle in its extended position. The lowered position of the elevating mechanism is shown in phantom lines.
Figure 3:
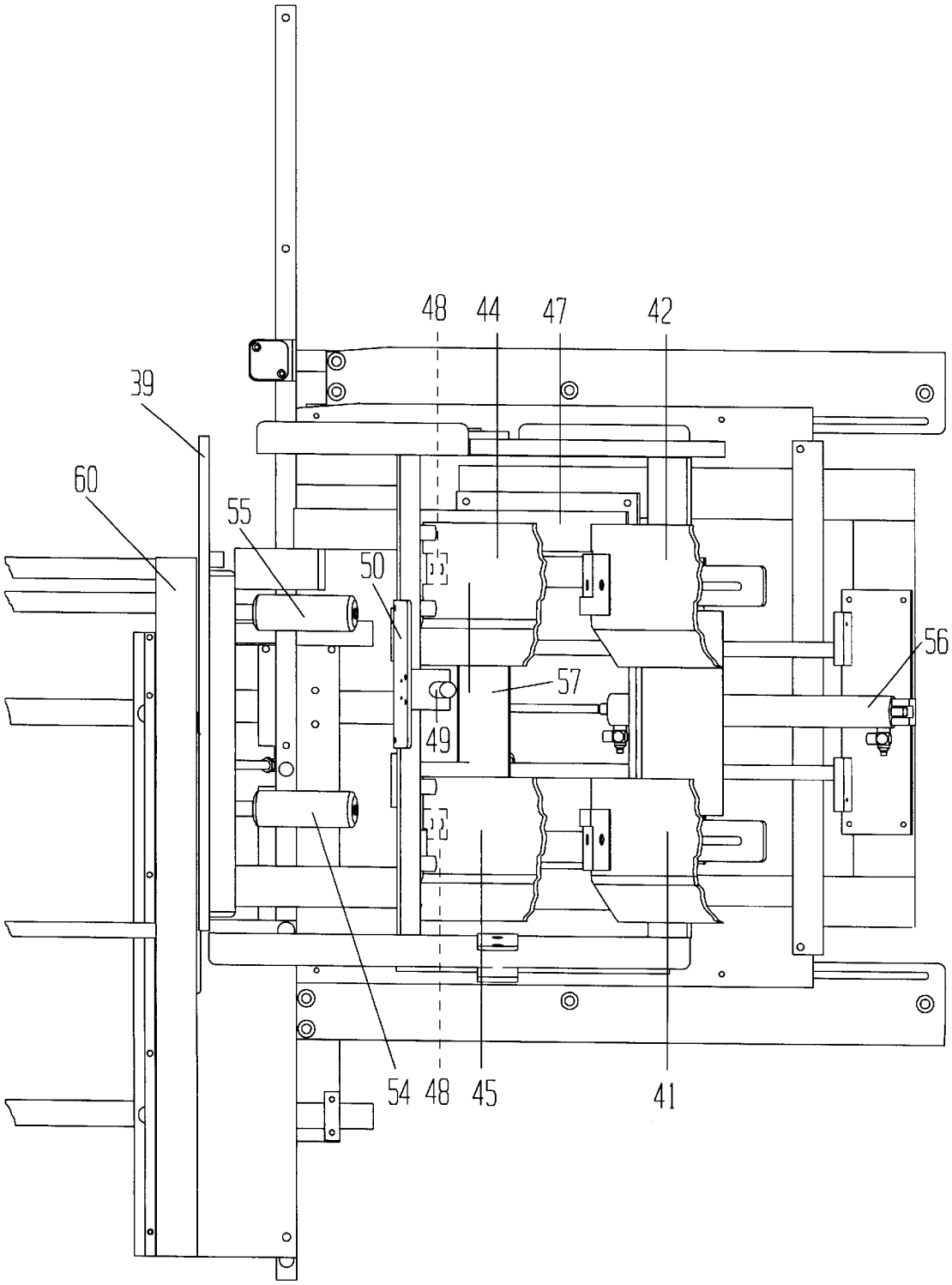
FIG. 3 is a sectional top view along line 3—3 of FIG. 1 showing detail of the shuttle and elevating mechanism.

While detail of the operative structures of the right side hopper (41–45) is illustrated in FIGS. 2*a*–2*c* and 3, identical structures are present in the left side hopper (31–35). Referring particularly to FIGS. 2*a*–2*c,* it is seen that a support platform 47 is provided below the hopper panel guides 41–45 to hold end panels 39. An adjustable slidable member 57 is provided below gudies 41–45 and above support platform 47, and is attached to an adjustable oscillating member 56. While a member 56 is illustrated as a piston, any appropriate mechanical oscillation device (e.g. an arm and cam) could be used to impart oscillating movement to member 57. Member 57 is moved between a retracted position behind said guides to an extended position below and slightly in front of said guides. By moving from the retracted position to the extended position, member 57 pushes the lowermost panel 39 out from under guides 41–45. An adjustable gate 48 is provided below guides 44 and 45 to prevent more than one end panel 39 from sliding out from under these guides through the operation of slidable member 57. The space between gate 48 and platform 47 may be adjusted depending upon the cross-sectional thickness of the end panels 39 being used. Gaps are provided in platform 47, below which a plurality of elevating members 54 and 55 are provided. Elevating members 54 and 55 move from between a substantially horizontal position (shown in FIG. 2*a*) to a vertical position (shown in FIG. 2*c*).

Referring particularly to FIG. 2*a,* it is seen that slidable member 57 is in a retracted position, the lowermost end panel 39 resting on support platform 47. Gate 48 has been adjusted so as to only allow a single end panel 39 to pass between the lowermost edge of panel guides 44 and 45 and platform 47. FIG. 2*b* shows the position of the lowermost end panel 39 after the extension of slidable member 57. This panel has been moved from the bottom of the stack, and is resting on platform 47 with elevating members 54 and 55 below it. In FIG. 2*b* slidable member 57 has already retracted back, its extended position being shown in phantom lines. In FIG. 2*c,* it is seen that the elevating members 54 and 55 have raised panel 39 to a vertical position along the side of mandrel 60. Slidable member 57 is shown in its extended position. The mandrel 60 is now free to take panel 39 into the machine for use in forming a container. Slidable member 57 will then retract, and elevating members 54 and 55 will drop down, and this cycle of operation will repeat over and over. In each cycle, the lowermost end panel 39 is delivered out of the hopper and is stood up in a vertical position alongside the mandrel 60.

In the preferred embodiment, the panel guides of the present invention are made of sturdy metal, such as aluminum. They should be easily adjustable and replaceable to accommodate different shaped end panels.

In an alternative embodiment, an end panel striker and support plate may be provided on one or both of the hoppers to impart slight movement to the panels stacked therein to prevent the panels from bunching up or binding in the hopper(s) as they move through.

Figure 5:
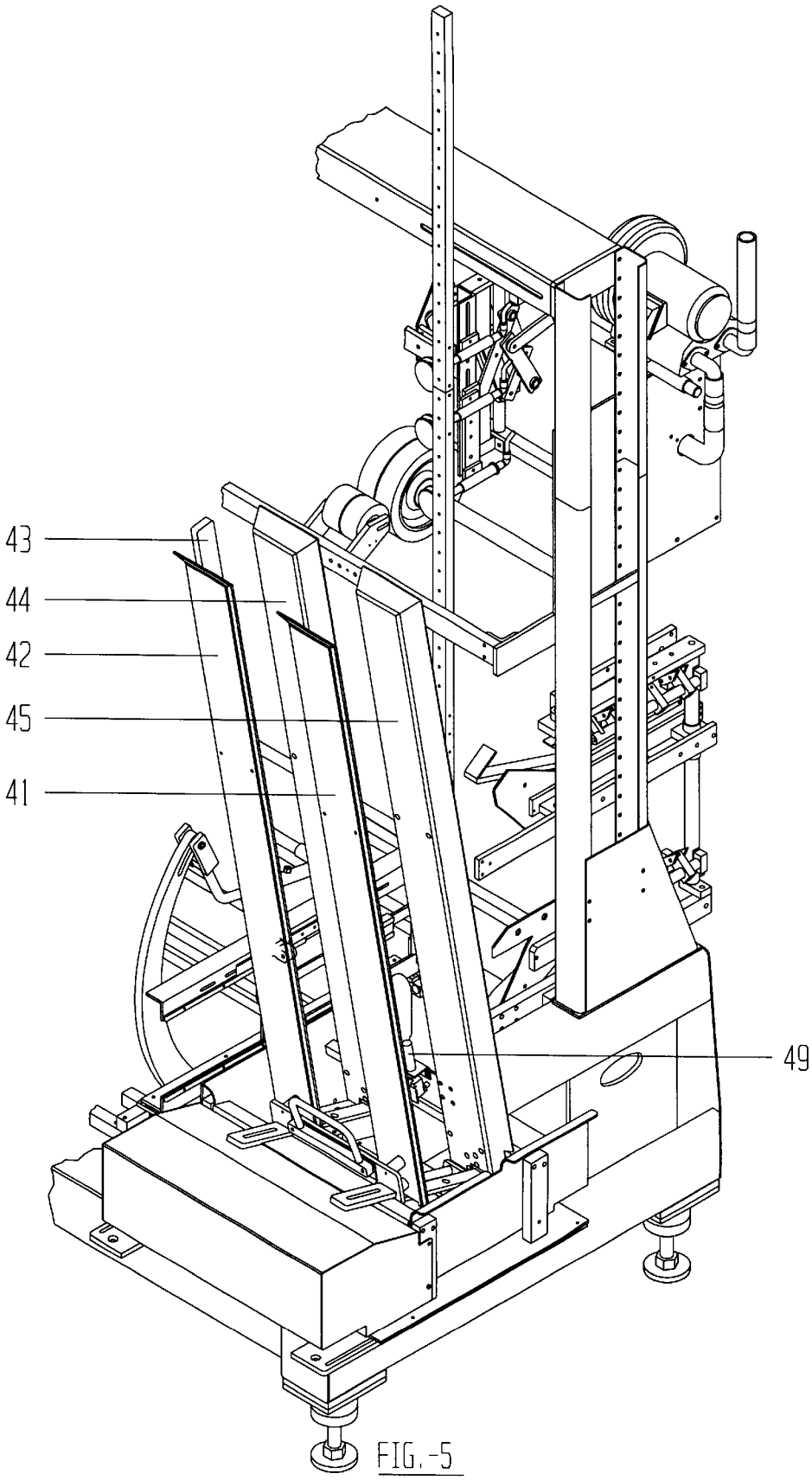
FIG. 5 is a perspective view of the invention shown in a different attachment to a container forming machine.

In another alternative embodiment shown in FIG. 5, it is seen that the hoppers of the present invention may be rotated ninety degrees in order to accommodate extremely wide end panels. The operation of the hoppers in this configuration is essentially the same as before, except that the end panels 39 are introduced over elevating members 54 and 55 from the back instead of from the side.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An apparatus for supplying panels to a container forming machine having a mandrel movably mounted on a path for oscillating motion between extended and retracted positions comprising a pair of vertically oriented hoppers located on opposite sides of said path, each such hopper including a plurality of adjustable vertically oriented guides for holding stacks of horizontally oriented panels, an adjustable shuttle located at the bottom of each hopper for removing the lowermost panel from the stack in each such hopper, an adjustable gate located adjacent to each shuttle to prevent undesired panels from being removed from such hopper, and a retractable lifting apparatus adjacent to each shuttle for moving said lowermost panel from its horizontally oriented position to a vertical position next to said mandrel.

2. The apparatus of claim 1 wherein a platform is provided below the guides of each hopper, and each of said shuttles is provided between the bottoms of said guides and each such platform.

3. The apparatus of claim 2 wherein said each shuttle includes an adjustable slidable member attached to an adjustable oscillating member, said oscillating member moving said slidable member between a retracted position behind said guides to an extended position below and slightly in front of said guides for removing the lowermost panel from each stack.

4. The apparatus of claim 3 wherein said adjustable gate is provided attached to the bottoms of the guides of each hopper at a position between the retracted and extended positions of said slidable member for preventing more than one panel at a time from exiting from each hopper through the action of said slidable member.

5. The apparatus of claim 1 wherein at least one elevating member is provided adjacent to the extended position of each slidable member for moving a panel removed from each stack to a vertical position adjacent to said mandrel.

6. The apparatus of claim 5 wherein a striker is provided near the bottom of each hopper to impart motion to the stacks of panels located therein to prevent said panels from becoming jammed in said hoppers.

7. The apparatus of claim 5 wherein the guides of each hopper are adjustable to a completely vertical position.

8. The apparatus of claim 5 wherein the guides of each hopper may be rotated ninety degrees relative to said shuttle to accommodate stacks of wide end panels.

9. A combination of a machine for forming three-part containers including a mandrel movably mounted on a path and an end panel supply apparatus, said supply apparatus comprising a pair of vertically oriented hoppers located on opposite sides of the path of said mandrel, each such hopper including a plurality of adjustable vertically oriented guides for holding stacks of horizontally oriented panels, an adjustable shuttle located at the bottom of each hopper for removing the lowermost panel from the stack in each such hopper, an adjustable gate located adjacent to each shuttle to prevent undesired panels from being removed from such hopper, and a retractable lifting apparatus adjacent to each shuttle for moving said lowermost panel from its horizontally oriented position to a vertical position next to said mandrel.

10. The combination of claim 9 wherein a platforn is provided below the guides of each hopper, and each of said shuttles is provided between the bottoms of said guides and each such platform.

11. The combination of claim 10 wherein said each shuttle includes an adjustable slidable member attached to an adjustable oscillating member, said oscillating member moving said slidable member between a retracted position behind said guides to an extended position below and slightly in front of said guides for removing the lowermost panel from each stack.

12. The combination of claim 11 wherein said adjustable gate is provided attached to the bottoms of the guides of each hopper at a position between the retracted and extended positions of said slidable member for preventing more than one panel at a time from exiting from each hopper through the action of said slidable member.

13. The combination of claim 12 wherein at least one elevating member is provided adjacent to the extended position of each slidable member for moving a panel removed from each stack to a vertical position adjacent to said mandrel.

14. The combination of claim 9 wherein a striker is provided near the bottom of each hopper to impart motion to the stacks of panels located therein to prevent said panels from becoming jammed in said hoppers.

15. The combination of claim 13 wherein the guides of each hopper are adjustable to a completely vertical position.

16. The combination of claim 13 wherein the guides of each hopper may be rotated ninety degrees relative to said shuttle to accommodate stacks of wide end panels.

17. An apparatus for supplying panels to a container forming machine having a mandrel movably mounted on a path for oscillating motion between extended and retracted positions comprising a pair of vertically oriented hoppers located on opposite sides of said path, each such hopper including a plurality of adjustable vertically oriented guides for holding stacks of said panels, an adjustable shuttle located at the bottom of each hopper for removing the lowermost panel from the stack in each such hopper, an adjustable gate located adjacent to each shuttle to prevent undesired panels from being removed from such hopper, and a lifting apparatus adjacent to each shuttle for bringing said lowermost panel into a vertical position next to said mandrel, wherein a platform is provided below the guides of each hopper, and each of said shuttles is provided between the bottoms of said guides and each such platform, and wherein said each shuttle includes an adjustable slidable member attached to an adjustable oscillating member, said oscillating member moving said slidable member between a retracted position behind said guides to an extended position below and slightly in front of said guides for removing the lowermost panel from each stack.

18. The apparatus of claim 17 wherein said adjustable gate is provided attached to the bottoms of the guides of each hopper at a position between the retracted and extended positions of said slidable member for preventing more than one panel at a time from exiting from each hopper through the action of said slidable member.

19. The apparatus of claim 17 wherein at least one elevating member is provided adjacent to the extended position of each slidable member for moving a panel removed from each stack to a vertical position adjacent to said mandrel.

20. The apparatus of claim 17 wherein a striker is provided near the bottom of each hopper to impart motion to the stacks of panels located therein to prevent said panels from becoming jammed in said hoppers.

21. The apparatus of claim 17 wherein the guides of each hopper are adjustable to a completely vertical position.

22. The apparatus of claim 17 wherein the guides of each hopper may be rotated ninety degrees relative to said shuttle to accommodate stacks of wide end panels.

23. A combination of a machine for forming three-part containers including a mandrel movably mounted on a path and an end panel supply apparatus, said supply apparatus comprising a pair of vertically oriented hoppers located on opposite sides of the path of said mandrel, each such hopper including a plurality of adjustable vertically oriented guides for holding stacks of said panels, an adjustable shuttle located at the bottom of each hopper for removing the lowermost panel from the stack in each such hopper, an adjustable gate located adjacent to each shuttle to prevent undesired panels from being removed from such hopper, and a lifting apparatus adjacent to each shuttle for bringing said lowermost panel into a vertical position next to said mandrel, wherein a platform is provided below the guides of each hopper, and each of said shuttles is provided between the bottoms of said guides and each such platform, and wherein said each shuttle includes an adjustable slidable member attached to an adjustable oscillating member, said oscillating member moving said slidable member between a retracted position behind said guides to an extended position below and slightly in front of said guides for removing the lowermost panel from each stack.

24. The combination of claim 23 wherein said adjustable gate is provided attached to the bottoms of the guides of each hopper at a position between the retracted and extended positions of said slidable member for preventing more than one panel at a time from exiting from each hopper through the action of said slidable member.

25. The combination of claim 23 wherein at least one elevating member is provided adjacent to the extended position of each slidable member for moving a panel removed from each stack to a vertical position adjacent to said mandrel.

26. The combination of claim 23 wherein a striker is provided near the bottom of each hopper to impart motion to the stacks of panels located therein to prevent said panels from becoming jammed in said hoppers.

27. The combination of claim 23 wherein the guides of each hopper are adjustable to a completely vertical position.

28. The combination of claim 23 wherein the guides of each hopper may be rotated ninety degrees relative to said shuttle to accommodate stacks of wide end panels.

* * * * *